US005711322A

United States Patent [19]

Tsugaya et al.

[11] Patent Number: 5,711,322

[45] Date of Patent: Jan. 27, 1998

[54] TOBACCO FILTER MATERIAL AND A METHOD OF PRODUCING THE SAME

[75] Inventors: Hitoshi Tsugaya, Kawachinagano; Syu Shimamoto, Himeji, both of Japan

[73] Assignee: Daicel Chemical Industries, Ltd., Osaka, Japan

[21] Appl. No.: 301,017

[22] Filed: Sep. 6, 1994

[30] Foreign Application Priority Data

Sep. 6, 1993 [JP] Japan ..... 5-246462
Jun. 3, 1994 [JP] Japan ..... 6-145578

[51] Int. Cl.[6] ..... A24D 3/08; A24D 3/10; A24D 3/16

[52] U.S. Cl. ..... 131/341; 342/343; 342/345

[58] Field of Search ..... 131/331, 332, 131/341, 342, 345, 343

[56] References Cited

U.S. PATENT DOCUMENTS

| | | | |
|---|---|---|---|
| 3,599,646 | 8/1971 | Berger et al. | 131/265 |
| 3,638,660 | 2/1972 | Davis | 131/2 |
| 3,711,687 | 1/1973 | Stout et al. | 162/258 |
| 3,880,173 | 4/1975 | Hill | 131/269 |
| 4,007,745 | 2/1977 | Randall et al. | 131/261 R |
| 4,047,862 | 9/1977 | Keith | 425/8 |
| 4,140,135 | 2/1979 | Godfrey, Jr. | 131/17 A |
| 4,145,246 | 3/1979 | Goheen et al. | 162/23 |
| 4,192,838 | 3/1980 | Keith et al. | 264/10 |
| 4,333,484 | 6/1982 | Keritsis | 131/2 |
| 4,460,647 | 7/1984 | Keith | 428/369 |
| 4,506,684 | 3/1985 | Keritsis | 131/369 |
| 4,613,406 | 9/1986 | Gess | 162/49 |
| 5,022,964 | 6/1991 | Crane et al. | 162/146 |
| 5,114,537 | 5/1992 | Scott et al. | 162/146 |
| 5,261,425 | 11/1993 | Raker et al. | 131/365 |
| 5,310,548 | 5/1994 | Tsuru et al. | 424/76.3 |
| 5,336,286 | 8/1994 | Alexander, Jr. et al. | 55/528 |
| 5,554,287 | 9/1996 | Beck et al. | 210/500.3 |
| 5,573,640 | 11/1996 | Frederick et al. | 162/146 |

FOREIGN PATENT DOCUMENTS

| | | |
|---|---|---|
| 52-96208 | 2/1976 | Japan . |
| 53-45468 | 5/1977 | Japan . |
| 780479 | 8/1957 | United Kingdom . |
| 1244609 | 9/1971 | United Kingdom . |
| 9209654 | 6/1992 | WIPO . |

OTHER PUBLICATIONS

Casey (Editor), "Pulp and Paper—Chemical and Chemical Technology", vol. No. 1, pp. 210–211 (Wiley–Interscience, Third Edition 1980).

*Primary Examiner*—Jeffrey Mullis
*Attorney, Agent, or Firm*—Cushman Darby & Cushman IP Group of Pillsbury Madison & Sutro, LLP

[57] ABSTRACT

Using a slurry containing a particulate or fibrous cellulose ester and a wood pulp with a Canadian standard freeness of 100 to 800 ml in a ratio of 10/90 to 90/10 (weight %), a tobacco filter material in the form of a sheet having a nonwoven web structure is produced. The slurry may contain a microfibrillated cellulose in a proportion of 0.1 to 10 weight % on a nonvolatile matter basis. The cellulose ester may be a cellulose acetate with a combined acetic acid in the range of 30 to 62%. This tobacco filter material in a sheet form can be applied to a tobacco filter having a high dry strength and, yet, a high degree of wet disintegratability without adversely affecting the smoking quality of tobacco. Thus, the potential environmental pollution is mitigated by the tobacco filter.

22 Claims, 1 Drawing Sheet

TOBACCO FILTER MATERIAL AND A METHOD OF PRODUCING THE SAME

FIELD OF THE INVENTION

The present invention relates to a tobacco filter material with very satisfactory wet disintegratability, a method of producing the tobacco filter material, and a tobacco filter insuring a good aroma and palatability of tobacco smoke as produced using the filter material.

BACKGROUND OF THE INVENTION

As a tobacco filter which removes tars from the tobacco smoke and insures a satisfactory smoking quality, a filter plug prepared by shaping a tow (fiber bundle) of cellulose acetate fiber with a plasticizer such as triacetin is known. In this filter, however, the constituent filaments have been partly fused together by the plasticizer so that when it is discarded after smoking, it takes a long time for the filter plug to disintegrate itself in the environment, thus adding to the pollution problem.

Meanwhile, a tobacco filter made of a creped paper manufactured from wood pulp and a tobacco filter made from a regenerated cellulose fiber are also known. Compared with a filter plug comprising a cellulose acetate fiber, these filters are slightly more wet-disintegratable and, thus, of somewhat lower pollution potential. However, in these filters, not only the aroma and palatability of tobacco smoke are sacrificed but the efficiency of selective elimination of phenols which is essential to tobacco filters can hardly be expected. Moreover, at the same pressure loss, the firmness or hardness of these filters is lower than that of the cellulose acetate filter.

Japanese Patent Application Laid-open No. 96208/1977 (JP-A-52-96208) discloses a sheet consisting of an acetylcellulose pulp prepared in a specified manner and short staples of a thermoplastic resin. However, because this sheet is manufactured by mix-webbing the pulp and short staples and heating the resulting paper under pressure, it is high in tensile strength and elongation after immersion in water as well as in water resistance and very low in disintegratability.

Japanese Patent Application Laid-open No. 45468/1978 (JP-A-53-45468) corresponding to U.S. patent application Ser. No. 730039 discloses a filter material comprising a nonwoven sheet containing 5 to 35 weight % of fine cellulose ester fibrils with a large surface area and 65 to 95 weight % of cellulose ester short staples. Furthermore, this prior art literature mentions that wood pulp may be incorporated in this mixture of cellulose ester fibrils and cellulose ester short staples. However, because cellulose esters can hardly be processed into fine fibrils, a special technique is required for providing the fine fibrils with a large surface area. Moreover, the disintegratability of this filter material is not sufficiently high so that the risk of pollution is substantial.

Furthermore, a tobacco filter material in sheet form is required to retain a high strength during dry handling but, then, its wet disintegratability is low. By the same token, a sheet material providing for a high degree of wet disintegratability shows only a low strength even in dry handling condition. Thus, the high dry sheet strength and high wet disintegratability can hardly be reconciled.

SUMMARY OF THE INVENTION

It is, therefore, an object of the present invention to provide a tobacco filter material which does not deteriorate smoking quality and provides for excellent wet disintegratability of the filter and, hence, alleviates the pollution burden on the environment and a method of producing the filter material.

It is a further object of the present invention to provide a tobacco filter material which disintegrates itself readily and fast when wetted despite its great dry strength and a method for its production. It is a still further object of the present invention to provide a tobacco filter material having an adequate pressure drop and a method for its production.

It is still another object of the present invention to provide a tobacco filter material which not only insures an efficient elimination of tar components but also contributes to an adequate permeation of nicotine and a process for its production.

A still another object of the present invention is to provide a tobacco filter having the above-mentioned meritorious characteristics. 10 The inventors of the present invention did an intensive research to accomplish the above-mentioned objects and found that a sheet-form artifact comprising a combination of cellulose ester and wood pulp does not impair or detract from the aroma and palatability of tobacco smoke and, yet, disintegrates itself readily under natural environmental conditions such as with rain water. The present invention has been completed on the basis of the above finding.

Thus, the tobacco filter material of the present invention comprises a cellulose ester and a wood pulp with a Canadian standard freeness value of 100 to 800 ml in a ratio of the former/the later=10/90 to 90/10 (weight %). The cellulose ester mentioned above is practically used in a granular or fibrous form, and the cellulose ester may contain anatase titanium dioxide. The filter material may further contain fine cellulose fibril. This filter material is generally used in the form of plain paper but may optionally be creped or embossed.

The tobacco filter of the present invention comprises the tobacco filter material in a sheet form. The tobacco filter may be formed by, for example, using the filter material, a wrapping paper for wrapping the filter material into a cylindrical form, and a water-soluble adhesive for gluing the wrapping paper.

In the production process of this invention, a 10 paper web is made by a paper-making technique using a slurry containing the cellulose ester and the wood pulp having a Canadian standard freeness value of 100 to 800 ml in a ratio of 10/90 to 90/10 (weight %) to provide a tobacco smoke filter material in a sheet form.

It should be understood that the term "sheet" as used in this specification means any paper-like entity having a two-dimensional expanse that can be taken up in the form of a roll.

DETAILED DESCRIPTION OF THE INVENTION

Figure 1:
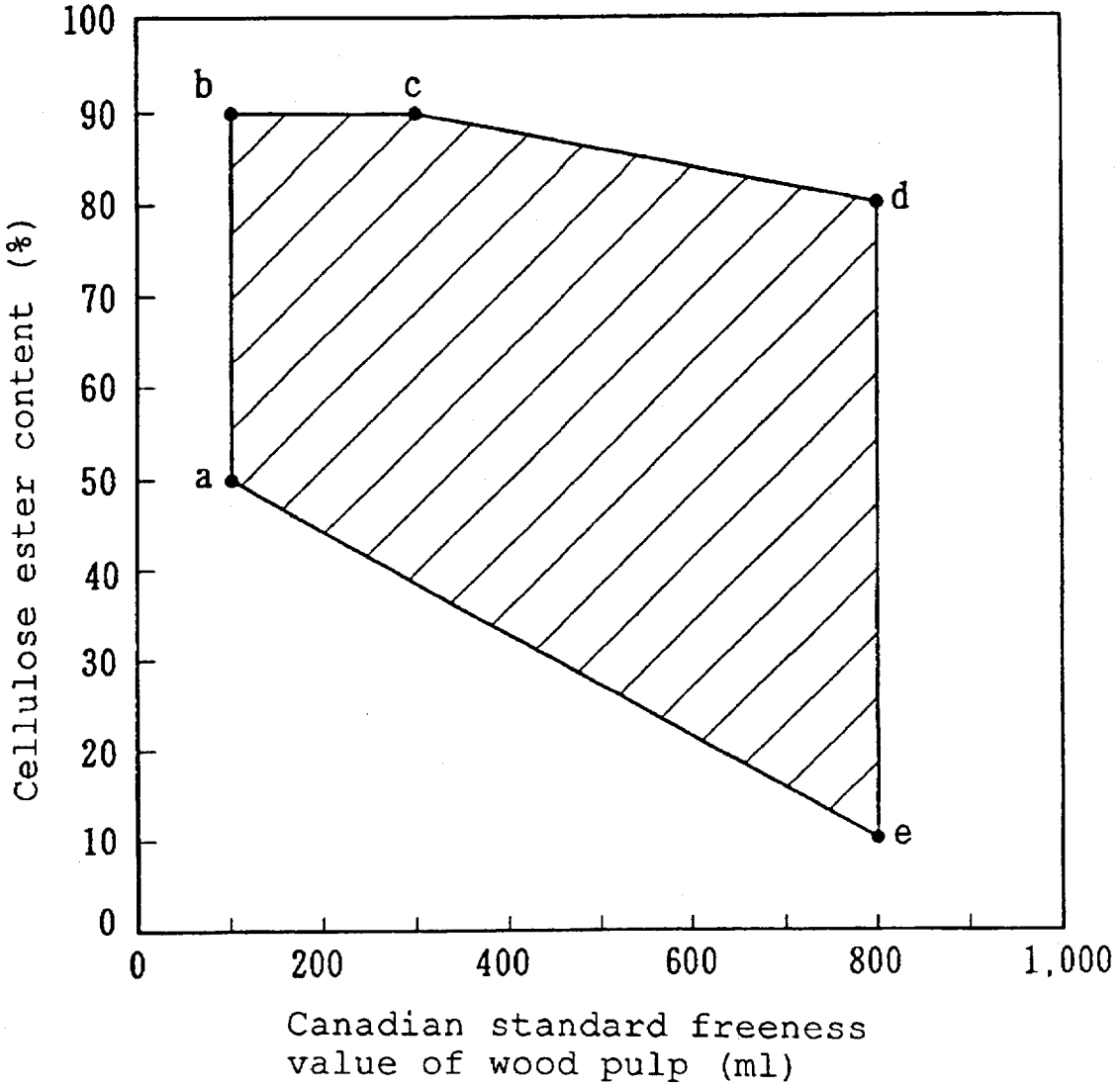
FIG. 1 is a diagram showing an example of the relationship between the amount of cellulose ester and the freeness of wood pulp, wherein the shaded area illustrates a preferred range of the amount of cellulose ester in the relationship to the freeness of wood pulp.

The cellulose ester mentioned above includes, for example, organic acid esters such as cellulose acetate, cellulose butyrate, cellulose propionate, etc.; inorganic acid esters such as cellulose nitrate, cellulose sulfate, cellulose phosphate, etc.; mixed acid esters such as cellulose acetate propionate, cellulose acetate butyrate, cellulose acetate phthalate, cellulose nitrate acetate, etc.; and cellulose ester derivatives such as polycaprolacton-grafted cellulose acetate and so on. These cellulose esters can be used singly or in combination.

The average degree of polymerization of the cellulose ester may for example be about 10 to 1000, preferably about 50 to 900 and more preferably about 200 to 800, and the average degree of substitution of the cellulose ester may for example be about 1 to 3. It should be understood that a cellulose ester grade with an average degree of substitution in the range of about 1 to 2.15, preferably about 1.1 to 2.0, is useful for promoting biodegradation.

The preferred cellulose ester includes organic acid esters (esters with e.g. organic acids having about 2–4 carbon atoms) and preferably is cellulose acetate. The combined acetic acid of cellulose acetate is generally about 43 to 62% but cellulose acetate grades with the combined acetic acid within the range of about 30 to 50% are satisfactory in biodegradability as well. Therefore, the recommended combined acetic acid for cellulose acetate is about 30 to 62%.

The morphology of such cellulose ester is not critical only if the ester can be fabricated into a sheet by a paper-making process. In many cases, the cellulose ester is used in a particulate (particularly powdery) form or in a fibrous form. The particle size of the particulate cellulose ester can be selected from a broad range not adversely affecting the web-formability and wet disintegratability. Thus, the average particle size may for example be about 0.1 to 600 μm, preferably about 10 to 500 μm, and more preferably about 20 to 250 μm. If the average particle size is less than 0.1 μm, the particles tend to be dislodged from the sheet, while the surface smoothness of the sheet tends to be sacrificed if the limit of 600 μm is exceeded.

The fiber fineness and fiber length of the fibrous cellulose ester can be suitably selected from the ranges not interfering with web formation, and the cellulose ester is generally used in the form of short staples. The fibrous cellulose ester may preferably have a fineness of 1 to 10 deniers (e.g. about 2 to 8 deniers) and a fiber length of 1 to 10 mm (e.g. about 2 to 8 mm). When the fineness is less than 1 D or the filament length is less than 1 mm, the sheet will not have a sufficient strength. On the other hand, if the fineness is greater than 10 D or the fiber length exceeds 10 mm, the web-formability of the materials will be deteriorated.

The sectional configuration of the fibrous cellulose ester is not critical and may for example be round (circular), oval (elliptical) or any other configuration. Thus, the fibrous cellulose ester may be of modified cross-section (e.g. Y-, X-, R- or I-shaped) or hollow. The fibrous cellulose ester may be crimped as necessary and is generally used in the non-crimped form.

The cellulose ester mentioned above preferably contains a whitening agent such as titanium dioxide, preferably the anatase form of titanium dioxide. The average particle size of such titanium dioxide may for example be about 0.1 to 10 μm and preferably about 0.2 to 5 μm. The amount of titanium dioxide based on the whole cellulose ester is about 0.05 to 2.0 weight %, preferably about 0.1 to 1 weight % and more preferably about 0.2 to 0.8 weight %, and practically in the range of about 0.4 to 0.6 weight %.

The present invention is characterized in that the above cellulose ester is used in combination with a wood pulp having a specified freeness value to provide for improved wet disintegratability. The wood pulp that can be used includes various pulps which are conventionally used in the manufacture of paper, for example hard wood and soft wood pulps produced by the sulfite process, kraft process and other known processes.

The wood pulp is generally fibrillated to impart paper-making quality. The fibrillation of wood pulp can be achieved by beating the pulp with a known beating machine. In the present invention, a wood pulp having a Canadian standard freeness value, i.e. a freeness value measured by means of a Canadian freeness tester, within the range of about 100 to 800 ml is employed. Practically, wood pulps having Canadian standard freeness values in the range of about 150 to 750 ml (e.g. about 150 to 700 ml) may be utilized. The freeness of wood pulp is a value representing the ease of drainage of a wood pulp slurry, and the higher the degree of fibrillation, the lower is the freeness value.

In this connection, wood pulp is mostly composed of cellulose containing many hydroxyl groups which have a high affinity for water so that it is swollen and dispersed evenly in water. Moreover, as it dries the interfiber bonding force is increased to form a tough paper layer. Moreover, beating increases the swelling capacity of wood pulp and produces whisker-like fibrils and, thus, the entanglement or interlacing of fibers is increased.

The ratio of cellulose ester to wood pulp is about the former/the later=10/90 to 90/10 and preferably about 15/80 to 80/20 (weight %). When the proportion of cellulose ester is less than 10 weight %, the aroma and palatability of tobacco smoke are sacrificed. On the other hand, if the proportion of cellulose ester exceeds 90 weight %, a compromise of strength occurs so that a sheet-like material cannot be easily obtained.

When the cellulose ester is particulate, the ratio of cellulose ester to wood pulp is generally about 10/90 to 85/15 (weight %) and preferably about 15/85 to 80/20 (weight %). When the cellulose ester is a fibrous material, the ratio of cellulose ester to wood pulp is generally about 25/75 to 85/15 (weight %) and preferably about 30/70 to 80/20 (weight %).

The proper cellulose ester content can be selected according to the freeness of the wood pulp to be used but it is generally effective to increase the proportion of cellulose ester as the freeness of wood pulp is decreased. Between the preferred cellulose ester content and the freeness of wood pulp, the relation diagrammatically shown in FIG. 1 is found. Thus, the amount of cellulose ester is preferably selected from the range defined by a line interconnecting points "a" through "e" in FIG. 1. The points "a" to "e" in FIG. 1 correspond to the following range.

Thus, when the cellulose ester content is plotted on the ordinate and the freeness of wood pulp on the abscissa, the proportion of cellulose ester is within the range defined by the following points.

| | Freeness or wood pulp | Proportion or cellulose ester |
|---|---|---|
| Points a, b: | 100 ml | 50 to 90% by weight |
| Point c: | 300 ml | 90% by weight |
| Points d, e: | 800 ml | 10 to 75% by weight |

When the freeness of wood pulp is 300 ml, the lower limit of cellulose ester is about 38% by weight. The cellulose ester content is the proportion of cellulose ester based on the filter material composed of cellulose ester and wood pulp.

When the cellulose ester and wood pulp are used within the above range, the resulting tobacco filter material in a sheet form shows excellent wet disintegratability despite its high dry strength. If the proportion of cellulose ester and the freeness value of wood pulp are outside the above-mentioned range defined by the line interconnecting points "a", "b", "c" and "d" in FIG. 1, the sheet-material is inadequate in strength so that it may not be easily worked up into a tobacco filter. Further, if the above parameters are outside the range defined by a line interconnecting points "d", "e" and "a", the resulting sheet-like material will not have a satisfactory wet disintegratability.

It is sufficient that the filter material of the present invention be composed of the cellulose ester and wood pulp but a sheet material further containing microfibrillated cellulose (microfine fibrous cellulose) which contributes to the strength of a sheet at a low level of addition is also desirable.

The microfibrillated cellulose mentioned above is a fine grade of cellulose fiber obtainable by subjecting an aqueous suspension of cellulose to high shearing and high impact forces so that the cellulose fibrils are cleaved and comminuted to a high degree of fineness. Such microfibrillated cellulose is a very fine fibrous material having, for example, a specific surface area of 100 to 300 $m^2/g$ and preferably about 150 to 250 $m^2/g$. The microfibrillated cellulose may have a fiber diameter of not greater than 2 μm (preferably about 0.01 to 1.5 μm), and a fiber length of 50 to 1,000 μm (preferably about 100 to 700 μm). The microfibrillated cellulose may have an average fiber diameter of about 0.01 to 1.0 μm and an average fiber length of about 200 to 800 μm in many instances. Therefore, when such a microfibrillated cellulose is to be incorporated, the freeness of wood pulp need not be controlled within the range defined in FIG. 1. Incidentally, such a microfibrillated cellulose is commercially available from Daicel Chemical industries, Ltd., Japan under the trade name of Celish.

The amount of microfibrillated cellulose relative to the whole sheet material may be selected according to the desired strength and disintegratability of the sheet material and may for example be 0.1 to 10 weight % and preferably 0.2 to 7 weight %. The proportion of microfibrillated cellulose can be practically about 0.3 to 7 weight % and preferably about 0.5 to 5 weight %. If the amount of microfibrillated cellulose is less than 0.1 weight %, the sheet-like filter material tends to be insufficient in strength. When it exceeds 10 weight %, the wet disintegratability tends to decrease.

The sheet-like filter material according to the present invention, comprising the constituent materials mentioned above, has a nonwoven web structure. The term "web structure" is used herein to mean a textural structure in which fibers are interlaced or entangled. For the above reason, the sheet-like filter material of the present invention has a high dry paper strength and yet disintegrates itself rapidly when wetted with rain water or the like.

It should be understood that the cellulose ester or the sheet-like filter material mentioned above may contain a variety of additives, e.g. sizing agents; finely divided inorganic substances such as kaolin, talc, diatomaceous earth, quartz, calcium carbonate, barium sulfate, alumina, etc.; heat stabilizers such as salts of alkaline earth metals, typically calcium and sodium; coloring agents; and retention aids. It is also possible to incorporate biodegradation promoters, e.g. citric acid, tartaric acid, malic acid, etc., and photodegradation promoters, e.g. the anatase titanium dioxide, so as to provide for greater degradability in addition to the high disintegratability.

Moreover, within the range not adversely affecting its disintegratability, the sheet-like filter material may contain plasticizers such as triacetin, triethylene glycol diacetate, etc. but the use of plasticizers designed to enhance wet disintegratability should preferably be avoided.

The sheet-like filter material of the present invention can be manufactured from (1) a slurry containing the cellulose ester and wood pulp or (2) a slurry containing the cellulose ester, wood pulp and microfibrillated cellulose, by means of a paper-making machine.

The solids content of the slurry can be freely selected within a range not interfering with mechanical web formation and may for example be about 0.005 to 0.5 weight %. The web formation can be carried out by the conventional procedure, for example using a wet paper machine provides with a perforated plate, followed by dehydration and drying.

Whereas the wet disintegratability of a sheet manufactured by molding a mixture containing a cellulose ester under heat and pressure by utilizing thermoplastic property of the cellulose ester is seriously low, the sheet obtained by the above process has a satisfactory wet disintegratability.

The tobacco filter material in a sheet form according to the present invention is useful for the manufacture of tobacco smoke filters (tobacco filter rods). The tobacco filter mentioned above can be manufactured by the conventional manufacturing process, for example by feeding the sheet material to a filter plug forming machine.

The filter material is preferably creped or embossed for insuring a smooth and uniform passage of tobacco smoke through the filter plug without channeling. By wrapping up the creped or embossed filter material or sheet material, a filter plug having a homogeneous cross section and an attractive appearance can be obtained. The creping can be effected by passing the sheet material through a pair of creping rolls formed with a multiplicity of grooves running in the direction of advance to thereby form wrinkles or creases and, to a lessor extent, fissures in the sheet along the direction of its advance. The embossing can be conducted by passing the sheet material over a roll formed with a grate or random relief pattern having convex and/or concave portions or pressing the sheet with a roller formed with such a relief pattern.

The pitch and depth of the grooves for creping and the pitch and depth of the embossing pattern can be selected from the range of about 0.5 to 5 mm for pitch and the range of about 0.1 to 1 mm for depth.

By the creping or embossing, there can be obtained a filter having a satisfactory permeability to tobacco smoke, for example a pressure drop (puff resistance) of about 200 to 600 mm WG (water gauge) and preferably about 300 to 500 mm WG.

In the plug forming machine mentioned above, the creped or embossed sheet-like filter material is set in a funnel, wrapped up with wrapping tissue or paper into a cylinder, glued and cut to length to provide filter plugs. In wrapping, the creped sheet-like filter material is practically wrapped in a direction substantially perpendicular to the lengthwise direction of the creases or wrinkles.

In the manufacture of filter plugs, where the gluing along edges of the wrapping paper formed into a cylinder and gluing between the cylindrical filter material and wrapping paper are necessary, a water-soluble adhesive is preferably used as the glue in order that the wet disintegratability will not be adversely affected. The water-soluble adhesive that can be used includes, for example, natural adhesives (e.g. starch, modified starch, soluble starch, dextran, gum arabic, sodium alginate, casein, gelatin, etc.); cellulose derivatives (e.g. carboxymethylcellulose, hydroxyethylcellulose, ethylcellulose, etc.); and synthetic resin adhesives (e.g. polyvinyl alcohol, polyvinylpyrrolidone, water-soluble acrylic resin, etc.). These water-soluble adhesives can be used singly or in combination.

With the tobacco smoke filter described above, the gratifying aroma (taste) and palatability of the tobacco smoke can be well retained. Thus, it is thought that tars in tobacco smoke are responsible for the bitter taste of the smoke, while nicotine imparts a gratifying taste to the tobacco smoke. The tobacco smoke filter of the present invention is more efficient than the cellulose acetate tow filter and is at least as efficient as the paper tobacco filter in the removal of tars. On the other hand, the permeability to nicotine of the filter of the present invention is greater than that of the paper filter and comparable to that of the cellulose acetate tow filter.

Since the tobacco filter material and tobacco filter according to the present invention are made up of cellulose ester and wood pulp, they do not detract from smoking quality and is excellent in wet disintegratability, thus reducing the potential pollution burden on the environment. Moreover, despite the high dry paper strength, they disintegrate themselves readily and rapidly when wetted. By the process of the present invention, a tobacco filter material having the above-mentioned meritorious characteristics can be manufactured.

The following examples are intended to describe this invention in further detail and should by no means be construed as defining the scope of the invention.

EXAMPLES

The freeness, weight and tensile strength data shown in the examples and comparative examples were evaluated by the following methods.

Canadian standard freeness (ml): Japanese Industrial Standards (JIS) P-8121

Weight ($m^2/g$): JIS-P-8121

Tensile strength (kg): JIS-P-8113, 15 mm-wide specimens. The tensile strength is represented by a mean value calculated from the strength in the mainly fiber-orientated direction and the strength in the perpendicular direction to the fiber-orientated direction.

Disintegratability was evaluated by the following procedure.

Water disintegratability (%): About 0.2 g of a sample was accurately weighed, put in a beaker containing 500 ml of water and stirred with a magnetic stirrer so that the center height of the vortex would be equal to 1/2 of the highest liquid level. After 30 minutes, the slurry was filtered through a 5-mesh metal screen and the dry weight of the filter cake was determined. Then, the water disintegratability (%) was calculated by means of the following equation for the assessment of wet disintegratability.

Water disintegratability (%)=100×[1=(B/A)] wherein A represents the weight (g) of the sample and B represents the dry weight (g) of the filter cake.

Example 1

Seventy (70) parts by weight of a non-crimped cellulose acetate short staple fiber of Y-cross section (fineness 3 deniers, fiber length 5 mm, combined acetic acid 55.5%) and 30 parts by weight of a bleached soft wood pulp with a Canadian standard freeness value of 274 ml were uniformly dispersed in 300,000 parts by weight of water and using the resulting slurry, a web was fabricated with a paper-making machine. This web was dehydrated and dried to provide a sheet weighing 27.9 $g/m^2$. This sheet had a composition corresponding to the charge and a tensile strength of 0.20 kg. The water disintegratability of the sheet was 91.5%.

Example 2

Seventy-five (75) parts by weight of a powdery cellulose acetate [80 to 140 mesh (100 to 180 μm), combined acetic acid 55.5%] and 25 parts by weight of a bleached soft wood kraft pulp with a Canadian standard freeness value of 432 ml were uniformly dispersed in 300,000 parts by weight of water and the resulting slurry was made into a web by using a paper-making machine. This web was dehydrated and dried to provide a sheet weighing 55.0 $g/m^2$. The sheet had a composition corresponding to the charge and a tensile strength of 0.60 kg and had a water disintegratability of 67.2%.

Example 3

Fifty (50) parts by weight of a non-crimped cellulose acetate short staple fiber of Y-cross section (fineness 3 deniers, fiber length 5 mm, combined acetic acid 55.5%) and 50 parts by weight of a bleached soft wood kraft pulp with a Canadian standard freeness value of 274 ml were uniformly dispersed in 300,000 parts by weight of water and the resulting slurry was subjected to a paper-making machine to form a web. This web was dehydrated and dried to provide a sheet weighing 30.5 $g/m^2$ and having a tensile strength of 0.64 kg. This sheet had a composition corresponding to the charge and the water disintegratability of the sheet was 84.5%.

Example 4

The procedure of Example 1 was repeated except that 40 parts by weight of a powdery cellulose acetate (80 to 140 mesh, combined acetic acid 55.5%) and 60 parts by weight of a bleached soft wood kraft pulp with a Canadian standard freeness value of 480 ml were used to provide a sheet weighing 26.5 $g/m^2$ and having a tensile strength of 0.72 kg. This sheet had a composition corresponding to the charge. The water disintegratability of the sheet was 87.5%.

Example 5

Sixty (60) parts by weight of a non-crimped cellulose acetate short staple fiber of Y-cross section (fineness 3 deniers, fiber length 5 mm, combined acetic acid 55.5%), 35 parts by weight of a bleached soft wood kraft pulp with a Canadian standard freeness value of 480 ml and 5 parts by weight of a microfibrillated cellulose (Daicel Chemical Industries, Ltd., Japan; Celish KY100-S, fiber length 500 μm, fiber diameter 0.01 to 0.1 μm) were uniformly dispersed in 300,000 parts by weight of water and the resulting slurry was made into a web by use of a paper-making machine. The web thus formed was dehydrated and dried to provide a sheet weighing 28.9 $g/m^2$ and having a tensile strength of 0.42 kg. The resultant sheet had a composition corresponding to the charge, and had a water disintegratability of 38%.

Example 6

The procedure of Example 5 was repeated except that 40 parts by weight of a non-crimped cellulose acetate short staple fiber of Y-cross section (fineness 3 deniers, fiber length 5 mm, combined acetic acid 55.5%), 57 parts by weight of a bleached soft wood kraft pulp with a Canadian standard freeness value of 480 ml and 3 parts by weight of a microfibrillated cellulose (Daicel Chemical industries, Ltd., Japan; Celish PC310-S, fiber length 600 μm, fiber diameter 0.1 to 1.0 μm) were used to provide a sheet weighing 26.5 g/m$^2$ and having a tensile strength of 0.82 kg. The resultant sheet had a composition corresponding to the charge. The water disintegratability of the sheet was 44%.

Example 7

The procedure of Example 5 was repeated except that 75 parts by weight of a non-crimped cellulose acetate short staple fiber of Y-cross section (fineness 3 deniers, fiber length 5 mm, combined acetic acid 55.5%), 24 parts by weight of a bleached soft wood kraft pulp with a Canadian standard freeness value of 502 ml and 1 part by weight of the same microfibrillated cellulose as used in Example 5 were used to provide a sheet weighing 79 g/m$^2$ and having a tensile strength of 0.71 kg. This sheet had a composition corresponding to the charge. The water disintegratability of this sheet was 67%.

Example 8

The procedure of Example 5 was repeated except that 20 parts by weight of a powdery cellulose acetate (80 to 140 mesh, a combined acetic acid of 55.5%), 79.5 parts by weight of a bleached soft wood kraft pulp with a Canadian standard freeness value of 204 ml and 0.5 part by weight of the same microfibrillated cellulose as used in Example 5 were used to provide a sheet weighing 33.5 g/m$^2$ and having a tensile strength of 1.58 kg. The sheet having a composition corresponding to the charge showed a water disintegratability of 70%.

Example 9

The procedure of Example 5 was repeated except that 50 parts by weight of a powdery cellulose acetate (80 to 140 mesh, a combined acetic acid of 55.5%), 45 parts by weight of a bleached soft wood kraft pulp with a Canadian standard freeness value of 690 ml and 5 parts by weight of the same microfibrillated cellulose as used in Example 5 were used to provide a sheet weighing 27.7 g/m$^2$ and having a tensile strength of 0.45 kg. This sheet had a composition corresponding to the charge and had a water disintegratability of 55%.

Example 10

The procedure of Example 5 was repeated except that 60 parts by weight of a powdery cellulose acetate (80 to 140 mesh, combined acetic acid 55.5%), 38 parts by weight of a bleached soft wood kraft pulp with a Canadian standard freeness value of 690 ml and 2 parts by weight of the same microfibrillated cellulose as used in Example 6 were used to provide a sheet weighing 50.2 g/m$^2$ and having a tensile strength of 0.72 kg. This sheet had a composition corresponding to the charge and had a water disintegratability of 63%.

Example 11

The procedure of Example 5 was repeated except that 20 parts by weight of a powdery cellulose acetate (80 to 140 mesh a acetic acid of 50.5%) 79 parts by weight of a bleached soft wood kraft pulp with a Canadian standard freeness value of 280 ml and 1 part by weight of the same microfibrillated cellulose as used in Example 5 were used to provide a sheet weighing 30.9 g/m$^2$ and having a tensile strength of 1.28 kg. The resulting sheet had a composition corresponding to the charge and showed a water disintegratability of 67%.

Example 12

The procedure of Example 5 was repeated except that 60 parts by weight of a powdery polycaprolactone-grafted cellulose acetate (80 to 140 mesh.), 36 parts by weight of a bleached soft wood kraft pulp with a Canadian standard freeness value of 291 ml and 4 parts by weight of the same microfibrillated cellulose as used in Example 5 were used to provide a sheet weighing 31.3 g/m$^2$ and having a tensile strength of 0.38 kg. The sheet having a composition corresponding to the charge showed a water disintegratability of 60%.

Comparative Example 1

The procedure of Example 5 was repeated except that 100 parts by weight of a bleached soft wood kraft pulp with a Canadian standard freeness value of 124 ml was used to provide a sheet weighing 27.7 g/m$^2$ and having a tensile strength of 3.14 kg. The water disintegratability of this sheet was 5%, indicating that the wet disintegratability of the sheet was insufficient.

Comparative Example 2

An attempt was made to manufacture a web in the same manner as Example 5 except that 100 parts by weight of a powdery cellulose acetate (80 to 140 mesh, a combined acetic acid of 55.5%) was used. As a result, no paper layer could be formed.

Comparative Example 3

An attempt was made to manufacture a web in the same manner as Example 5 except that 100 parts by weight of a non-crimped cellulose acetate short staple fiber of Y-cross section (fineness 3 deniers, fiber length 5 mm, a combined acetic acid of 55.5%) was used. As a result, no paper layer could be formed.

Example 13

The 28 cm-wide sheet-like filter material obtained in Example 5 was creped using a creping roll (surface temperature 150° C, groove pitch 2.0 mm, groove depth 0.7 mm) at a speed of 100 m/min. This creped filter material was worked up at a rate of 250 m/min. without addition of a plasticizer to fabricate a filter plug. This filter pug measuring 108 mm long by 23.5 mm in circumference had a plug weight of 1.088 g/plug and showed an excellent performance with a pressure drop of 359 mm WG.

Example 14

A filter plug was fabricated in the same manner as Example 13 except that carboxymethylcellulose was used as the water-soluble adhesive for wrapping. This filter plug measuring 108 mm long by 23.5 mm in circumference weighed 0.950 g/plug and showed an excellent performance with a pressure drop of 320 mm WG.

Example 15

The procedure of Example 1 was repeated except that 60 parts by weight of a non-crimped cellulose acetate short staple fiber of Y-cross section containing 0.5 weight % of anatase titanium dioxide (fineness 2.2 deniers, fiber length 4 mm, combined acetic acid 55.5%) and 40 parts by weight of a bleached soft wool kraft pulp with a Canadian standard freeness of 270 ml were used to provide a sheet-like filter material weighing 34 g/m$^2$.

This sheet-like filter material was creped using a creping roll (surface temperature 150° C, groove pitch 2.0 mm, groove depth 0.45 mm) and worked up without addition of a plasticizer to provide a filter plug. This filter plug measuring 100 mm long by 25.0 mm in circumference weighed 1.070 g/plug and had a pressure drop of 400 mm WG. It had a high degree of cross-sectional whiteness and a uniform appearance.

The filter plug thus obtained was cut to provide a 15 mm-long filter tip. This filter tip was mounted on a suction device and the rates of removal of tar and nicotine from 0.700±0.05 g of a commercial tobacco leaf (Japan Tobacco, Inc., Japan; trade name of Piece Light) were measured. The results are shown in the Table.

Comparative Examples 4 and 5

The tar and nicotine removal rates were determined in the same manner as Example 15 except that a commercial cellulose acetate fiber tow filter (Comparative Example 4) and a paper filter (Comparative Example 5) were respectively used in lieu of the filter tip of Example 15. The results are shown in the Table.

TABLE

| | The rates of removal of tar (%) | The rates of removal of nicotine (%) |
|---|---|---|
| Example 15 | 59.1 | 40.4 |
| Comparative Example 4 | 47.0 | 37.2 |
| Comparative Example 5 | 55.6 | 44.9 |

It is apparent from the table that the filter of Example 15 was superior to the filters of Comparative Examples 4 and 5 in the removal rate of tar and superior to the tobacco filter of Comparative Example 5 and comparable to the filter of Comparative Example 4 in the permeability of nicotine.

Example 16

The procedure of Example 1 was repeated except that 60 parts by weight of a non-crimped cellulose acetate short staple fiber of R-cross section containing 0.5 weight % of anatase titanium dioxide (fineness 4 deniers, fiber length 4 mm, combined acetic acid 55.5%) and 40 parts by weight of a bleached soft wool kraft pulp with a Canadian standard freeness of 270 ml were used to provide a sheet-like filter material weighing 28 g/m$^2$.

This sheet-like filter material was creped using a creping roll (surface temperature 150° C, groove pitch 2.0 mm, groove depth 0.60 mm) and worked up without addition of a plasticizer to provide a filter plug. This filter plug measuring 100 mm long by. 24.6 mm in circumference weighed 0.872 g/plug and had a pressure drop of 333 mm WG. It had a high degree of cross-sectional whiteness and a uniform appearance.

What is claimed is:

1. A tobacco filter material in the form of a sheet having a web structure which is substantially free from a plasticizing substance and is wet-disintegratable, said filter material comprising a mixture of a cellulose ester having a combined organic acid content of 30 to 62% and having a either particulate form with an average particle diameter of 0.1 to 600 μm or a non-crimped fibrous form with a fiber fineness of 1 to 10 deniers and a fiber length of 1 to 10 mm and a wood pulp with a Canadian standard freeness of 150 to 700, wherein the proportion of said cellulose ester relative to said wood pulp is 15/85 to 80/20 (weight %).

2. A tobacco filter material in the form of a sheet as claimed in claim 1 wherein said cellulose ester is a particulate or fibrous material containing anatase titanium dioxide.

3. A tobacco filter material in the form of a sheet as claimed in claim 1 wherein said cellulose ester is an ester with an organic acid having 2 to 4 carbon atoms.

4. A tobacco filter material in the form of a sheet as claimed in claim 1 wherein said cellulose ester is a cellulose acetate having a combined acetic acid within the range of 30 to 62%.

5. A tobacco filter material in the form of a sheet as claimed in claim 1, wherein, when X represents the Canadian standard freeness of the wood pulp and Y represents the proportion (weight %) of said cellulose ester in a filter material consisting of cellulose ester and wood pump, and Y is expressed in terms of X, Y is within the range defined by lines derived from the following equations (1) through (5):

(1) X=150

(2) X=700

(3) Y=90

(4) Y=−0.057X+55.7

(5) Y=−0.03X+99.

6. A tobacco filter material in the form of a sheet as claimed in claim 1, which further comprises microfibrillated cellulose.

7. A tobacco filter material in the form of a sheet as claimed in claim 6 wherein said microfibrillated cellulose has a fiber diameter of not greater than 2 μm and a fiber length of 50 to 1,000 μm.

8. A tobacco filter material in the form of a sheet as claimed in claim 6, the proportion of the microfibrillated cellulose is 0.1 to 10 weight % relative to the total weight of the filter material.

9. A tobacco filter material in the form of a sheet as claimed in claim 1 which is creped or embossed.

10. A tobacco filter material in the form of a sheet as claimed in claim 1 wherein the cellulose ester fiber comprises a non-crimped fiber.

11. A tobacco filter material in the form of sheet having a web structure which is substantially free from a plasticizing substance, and is wet-disintegratable and comprises a mixture of 15 to 80 weight % of a cellulose acetate with a combined acetic acid content in the range of 30 to 62% and having either a particulate form with an average particle diameter of 0.1 to 600 μm or a non-crimped fibrous form with a fiber fineness of 1 to 10 deniers and a fiber length of 1 to 10 mm and 85 to 20 weight % of a wood pulp with a Canadian standard freeness in the range of 150 to 700.

12. A tobacco filter material in the form of a sheet as claimed in claim 11, which further comprises 0.5 to 5 weight % of a microfibrillated cellulose with a fiber diameter of 0.01 to 1.5 μm and a fiber length of 100 to 700 μm.

13. A tobacco filter material in the form of a sheet as claimed in claim 11 which is creped or embossed.

14. A tobacco filter material in the form of a sheet as claimed in claim 11 wherein the cellulose acetate is a powdery cellulose ester having an average particle diameter of 10 to 500 μm or a fibrous cellulose ester having a fiber fineness of 2 to 8 deniers and a fiber length of 2 to 8 mm.

15. A tobacco filter material in the form of a sheet as claimed in claim 11 wherein the cellulose ester fiber comprises a non-crimped fiber.

16. A tobacco filter comprising a tobacco filter material which is substantially free from a plasticizing substance and is wet-disintegratable, and comprises (1) a mixture of a cellulose ester having a combined organic acid content of 30 to 62% and having either a particulate form with an average particle diameter of 0.1 to 600 μm or a non-crimped fibrous form with a fiber fineness of 1 to 10 deniers and a fiber length of 1 to 10 mm and a wood pulp having a Canadian standard freeness value of 150 to 700, wherein the proportion of said cellulose ester relative to said wood pulp is 15/85 to 80/20 (weight %) or (2) a mixture of a cellulose ester having a combined organic acid content of 30 to 62% and having either a particulate form with an average particle diameter of 0.1 to 600 μm or a non-crimped fibrous form with a fiber fineness of 1 to 10 deniers and a fiber length of 1 to 10 mm, a wood pulp having a Canadian standard freeness value of 150 to 700 and a microfibrillated cellulose, wherein the proportion of said cellulose ester relative to said wood pulp is 15/85 to 80/20 (weight %).

17. A tobacco filter as claimed in claim 16 comprising a sheet form of tobacco filter material, a wrapping paper for wrapping the filter material into a cylinder and a water-soluble adhesive for gluing said wrapping paper to provide a filter plug.

18. A tobacco filter as claimed in claim 16, wherein in the ratio said cellulose ester relative to wood pulp is 15/85 to 80/20 (weight %) when said cellulose ester is in a particulate form, and when said cellulose ester is in a fibrous form the ratio of said cellulose ester relative to wood pulp is 30/70 to 80/20 (weight %).

19. A tobacco filter as claimed in claim 16 wherein said microfibrillated cellulose has a specific surface area of 100 to 300 $m^2/g$.

20. A tobacco filter as claimed in claim 16 which has a pressure drop of 200 to 600 mm WG.

21. A tobacco filter as claimed in claim 16 wherein said tobacco filter material in the form of a sheet is creped or embossed.

22. A tobacco filter material according to claim 16 wherein said tobacco filter material is in the form of a sheet and the cellulose ester fiber comprises a non-crimped fiber.

* * * * *